US009947455B2

(12) United States Patent
Nagai et al.

(10) Patent No.: US 9,947,455 B2
(45) **Date of Patent: *Apr. 17, 2018**

(54) MULTILAYER COIL COMPONENT

(71) Applicant: TDK CORPORATION, Tokyo (JP)

(72) Inventors: Yuusuke Nagai, Tokyo (JP); Kunihiko Kawasaki, Tokyo (JP); Yoshimitsu Satoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/276,170

(22) Filed: Sep. 26, 2016

(65) Prior Publication Data

US 2017/0103842 A1 Apr. 13, 2017

(30) Foreign Application Priority Data

Oct. 8, 2015 (JP) ..... 2015-200245

(51) Int. Cl.

| | |
|---|---|
| ***H01F 5/00*** | (2006.01) |
| ***H01F 27/245*** | (2006.01) |
| ***H01F 27/255*** | (2006.01) |
| ***H01F 27/28*** | (2006.01) |
| ***H01F 3/14*** | (2006.01) |
| ***H01F 17/00*** | (2006.01) |

(52) U.S. Cl.

CPC ..... *H01F 27/245* (2013.01); *H01F 3/14* (2013.01); *H01F 5/00* (2013.01); *H01F 17/0013* (2013.01); *H01F 27/255* (2013.01); *H01F 27/2804* (2013.01); *H01F 2027/2809* (2013.01)

(58) Field of Classification Search

CPC ..... H01F 5/00; H01F 27/00–27/36
USPC ..... 336/65, 83, 200, 233–234
See application file for complete search history.

(56) References Cited

U.S. PATENT DOCUMENTS 5,694,030 A * 12/1997 Sato ..... G05F 1/575 323/282
5,964,030 A 10/1999 Lee et al.
(Continued)

FOREIGN PATENT DOCUMENTS

JP 2006202880 A * 8/2006
JP 2006318946 A * 11/2006 ..... H01F 17/0013
(Continued)

*Primary Examiner* — Tuyen Nguyen
(74) *Attorney, Agent, or Firm* — Oliff PLC

(57) ABSTRACT

A coil includes a plurality of internal conductors that are electrically connected to each other and are disposed in an element body having magnetism. The plurality of internal conductors includes conductor portions that are separated from each other in a first direction and overlap each other when viewed from the first direction. At least one low-permeability layer is disposed along the conductor portions between the internal conductors adjacent to each other in the first direction. Permeability of the low-permeability layer is lower than permeability of the element body. The low-permeability layer includes a first portion contacting the internal conductors and at least one second portion separated from the internal conductors in the first direction, between the internal conductors adjacent to each other. The element body includes first element body regions that are interposed between the second portion and the internal conductors.

5 Claims, 11 Drawing Sheets

(56) References Cited

U.S. PATENT DOCUMENTS

| | | | | |
|---|---|---|---|---|
| 8,633,794 | B2 * | 1/2014 | Ito | H01F 17/0013 336/200 |
| 2006/0152325 | A1 * | 7/2006 | Nakao | H01F 17/0013 336/223 |
| 2010/0033286 | A1 * | 2/2010 | Katayama | H01F 17/0013 336/200 |
| 2011/0095856 | A1 * | 4/2011 | Nakajima | B32B 18/00 336/177 |
| 2013/0027171 | A1 * | 1/2013 | Ito | H01F 17/0013 336/200 |
| 2014/0247102 | A1 * | 9/2014 | Kurobe | H01F 5/003 336/200 |

FOREIGN PATENT DOCUMENTS

| | | | | | |
|---|---|---|---|---|---|
| JP | 2008-021788 | A | | 1/2008 | |
| JP | 2008021788 | A | * | 1/2008 | H01F 3/14 |
| JP | 2008-078229 | A | | 4/2008 | |
| JP | 2010109281 | A | * | 5/2010 | H01F 17/0013 |
| JP | 2010153618 | A | * | 7/2010 | |

* cited by examiner

MULTILAYER COIL COMPONENT

TECHNICAL FIELD

The present invention relates to a multilayer coil component.

BACKGROUND

Each of Japanese Unexamined Patent Publication No. 2008-78229 and Japanese Unexamined Patent Publication No. 2008-21788 discloses a multilayer coil component that includes an element body including a magnetic portion, a coil including a plurality of internal conductors disposed in the element body, and a non-magnetic layer. The plurality of internal conductors includes conductor portions that are separated from each other in a first direction and overlap each other when viewed from the first direction. The non-magnetic layer is disposed between the internal conductors adjacent to each other in the first direction and is disposed along the overlapping portion. Because the non-magnetic layer is disposed in the element body, a direct-current superposition characteristic of the multilayer coil component is improved.

SUMMARY

In the multilayer coil component, the magnetic portion, the internal conductors, and the non-magnetic layer are formed of materials in which shrinkage factors during firing and shrinkage factors after thermal expansion are different. In boundary portions of the magnetic portion, the internal conductors, and the non-magnetic layer, internal stress is generated due to a different of the shrinkage factors described above. For this reason, if a shearing stress along the first direction is generated in the boundary portions, a crack may be generated in the boundary portions.

An object of one aspect of the present invention is to provide a multilayer coil component in which a direct-current superposition characteristic is improved and generation of a crack is suppressed.

A multilayer coil component according to one aspect of the present invention includes an element body having magnetism, a coil, and at least one low-permeability layer. The coil includes a plurality of internal conductors that are electrically connected to each other and are disposed in the element body. The plurality of internal conductors includes conductor portions that are separated from each other in a first direction and overlap each other when viewed from the first direction. At least one low-permeability layer is disposed along the conductor portions between the internal conductors adjacent to each other in the first direction. Permeability of the low-permeability layer is lower than permeability of the element body. The low-permeability layer includes a first portion contacting the internal conductors and at least one second portion separated from the internal conductors in the first direction, between the internal conductors adjacent to each other. The element body includes first element body regions that are interposed between the second portion and the internal conductors.

In the multilayer coil component according to the one aspect, the low-permeability layer is disposed between the internal conductors adjacent to each other in the first direction and is disposed along the conductor portions. The low-permeability layer has the permeability lower than the permeability of the element body and includes the first portion. For this reason, magnetic flux generated around the individual internal conductors in the element body is blocked by the first portion of the low-permeability layer. As a result, generation of magnetic saturation is suppressed and a direct-current superposition characteristic is improved.

The low-permeability layer includes the second portion. The first element body regions are interposed between the second portion and the internal conductors. Therefore, boundaries between the internal conductors and low-permeability layer and the element body are not formed along the first direction and include surfaces crossing the first direction. For this reason, the boundaries between the internal conductors and low-permeability layer and the element body function as resistances against a shearing stress along the first direction and the shearing stress along the first direction is dispersed in a direction crossing the first direction. As a result, even when the shearing stress along the first direction is generated, a crack is hard to be generated in the element body.

In the multilayer coil component according to the one aspect, a thickness of the low-permeability layer in the first direction may be smaller than thicknesses of the internal conductors in the first direction. In this case, in the same element body, a region occupied by the low-permeability layer in the first direction is narrower than a region occupied by the internal conductors in the first direction. That is, the coil can be efficiently formed by increasing the region occupied by the internal conductors in the element body.

In the multilayer coil component according to the one aspect, the low-permeability layer may be located inside the internal conductors, when viewed from the first direction. In this case, regions where the element body is interposed between the internal conductors adjacent to each other in the first direction without interposing the low-permeability layer between the internal conductors are formed at an outside of the low-permeability layer and an inside of the internal conductors when viewed from the first direction. These regions continuously exist in the first direction without including a boundary with the low-permeability layer. For this reason, even when the shearing stress along the first direction is generated, the regions are hard to be sheared. Therefore, the cracks are hard to be generated in the element body.

In the multilayer coil component according to the one aspect, a diffusion layer in which a material included in the element body diffuse may be formed on a side of the second portion of the low-permeability layer. In this case, the diffusion layers are formed, so that a change of the material at the boundary of the element body and the low-permeability layer is gradual, and joining strength of the element body and the low-permeability layer is increased.

In the multilayer coil component according to the one aspect, the low-permeability layer may include a plurality of second portions. In this case, the plurality of second portions may be arranged in the first direction and the element body may include a second element body region that is interposed between the second portions arranged in the first direction. In the multilayer coil component of this embodiment, because the element body includes the second element body region in addition to the first element body regions, a boundary between one low-permeability layer and the element body is not formed along the first direction and crosses the first direction. For this reason, the boundary between one low-permeability layer and the element body functions as a resistance against a shearing stress along the first direction and the shearing stress along the first direction is dispersed in a direction crossing the first direction. As a result, strength against the shearing stress along the first direction is increased and the crack is hard to be generated.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION

Figure 1:
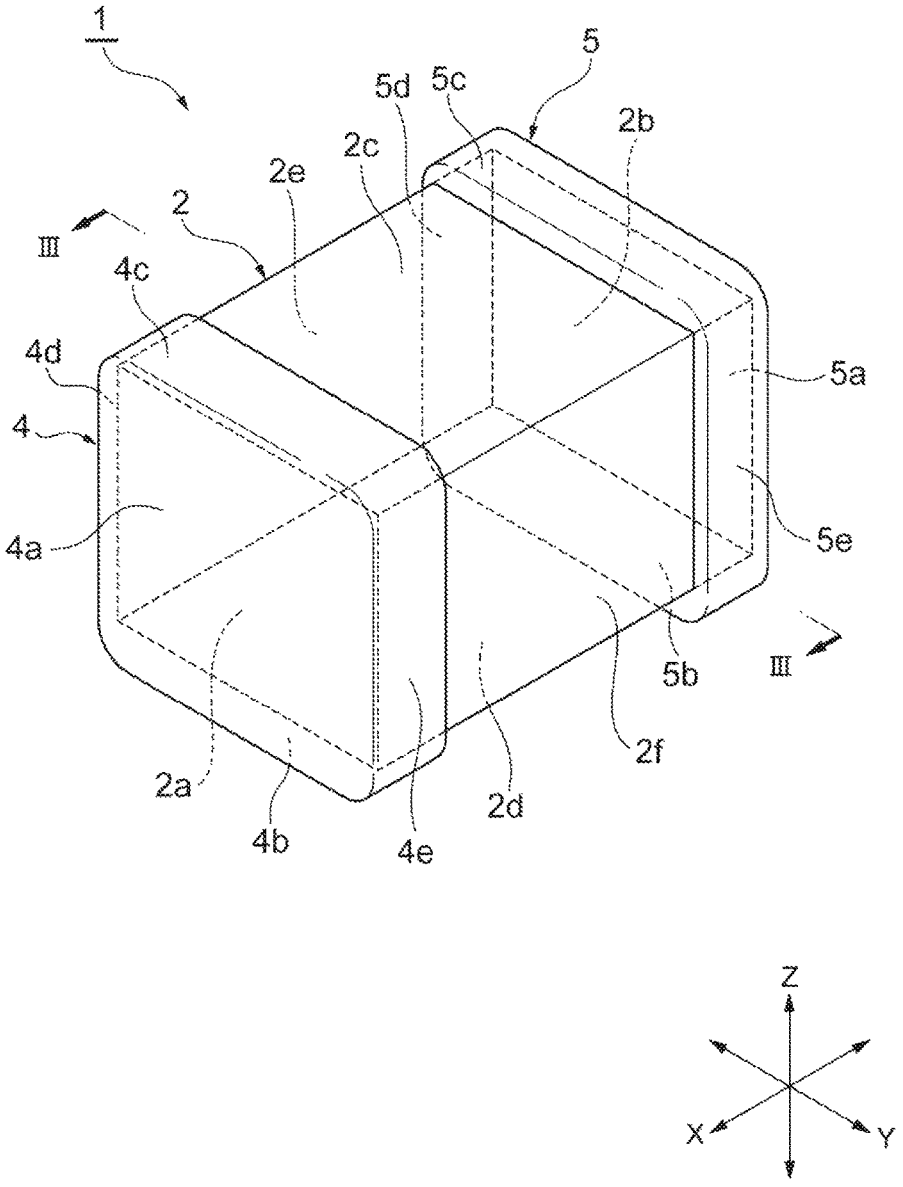
FIG. 1 is a perspective view illustrating a multilayer coil component according to a first embodiment.

Hereinafter, an embodiment of the present invention will be described in detail with reference to the attached drawings. In the following description, the same elements or elements having the same function are assigned the same reference numeral, and the redundant description will be omitted.

First Embodiment

Figure 2:
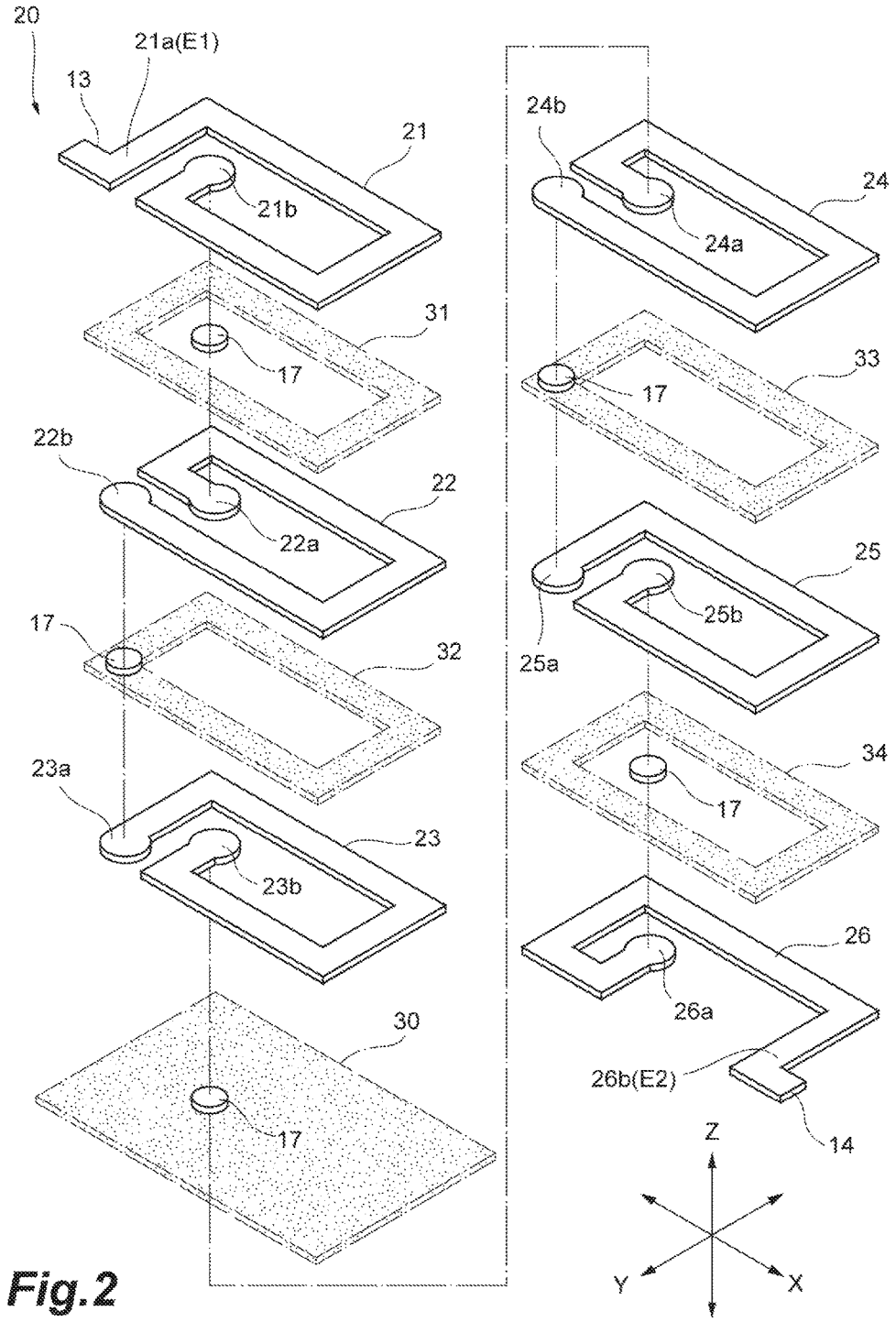
FIG. 2 is an exploded perspective view of the multilayer coil component illustrated in FIG. 1.
Figure 3:
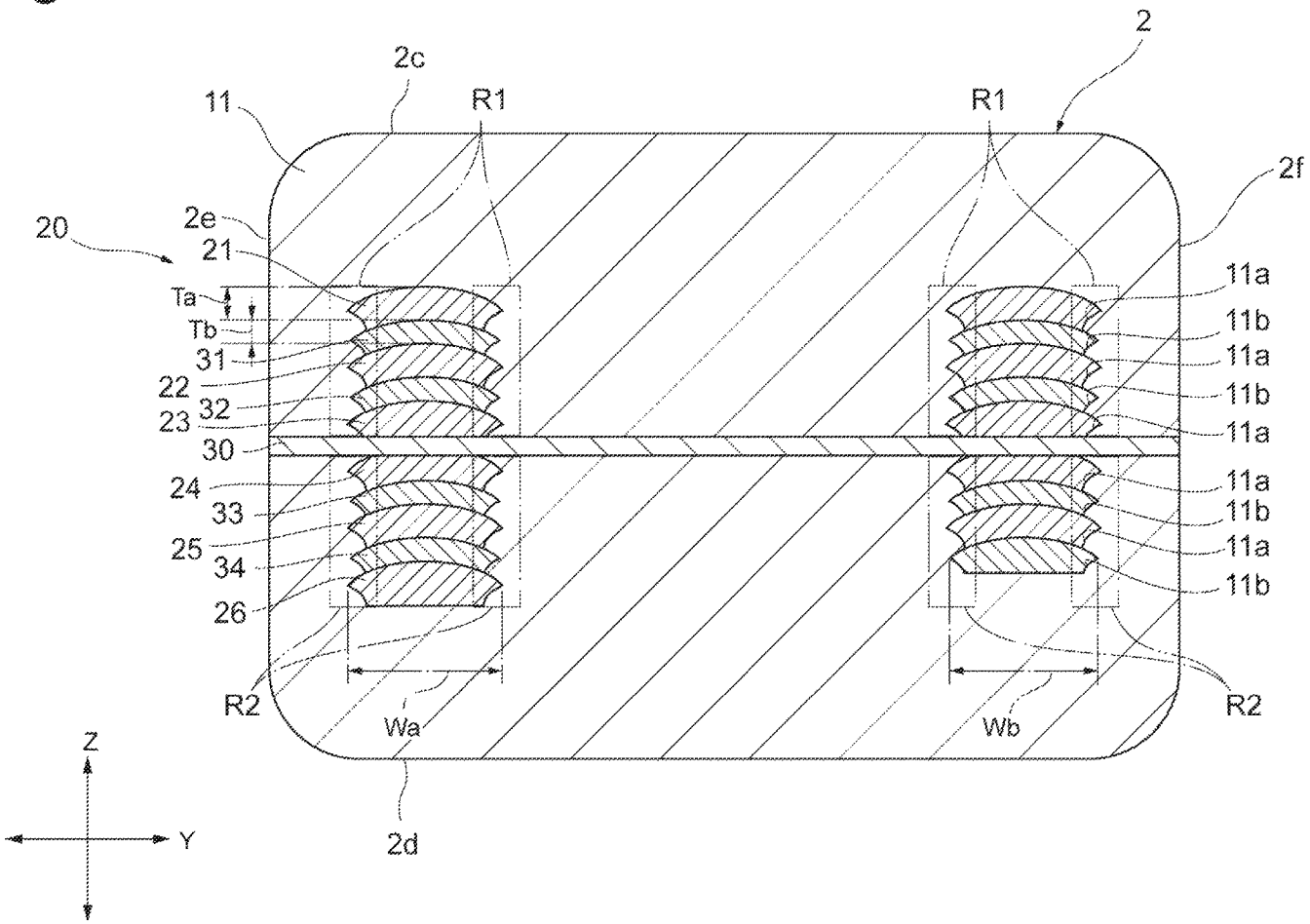
FIG. 3 is a cross-sectional view of an element body taken along the line III to III of FIG. 1.
Figure 4:
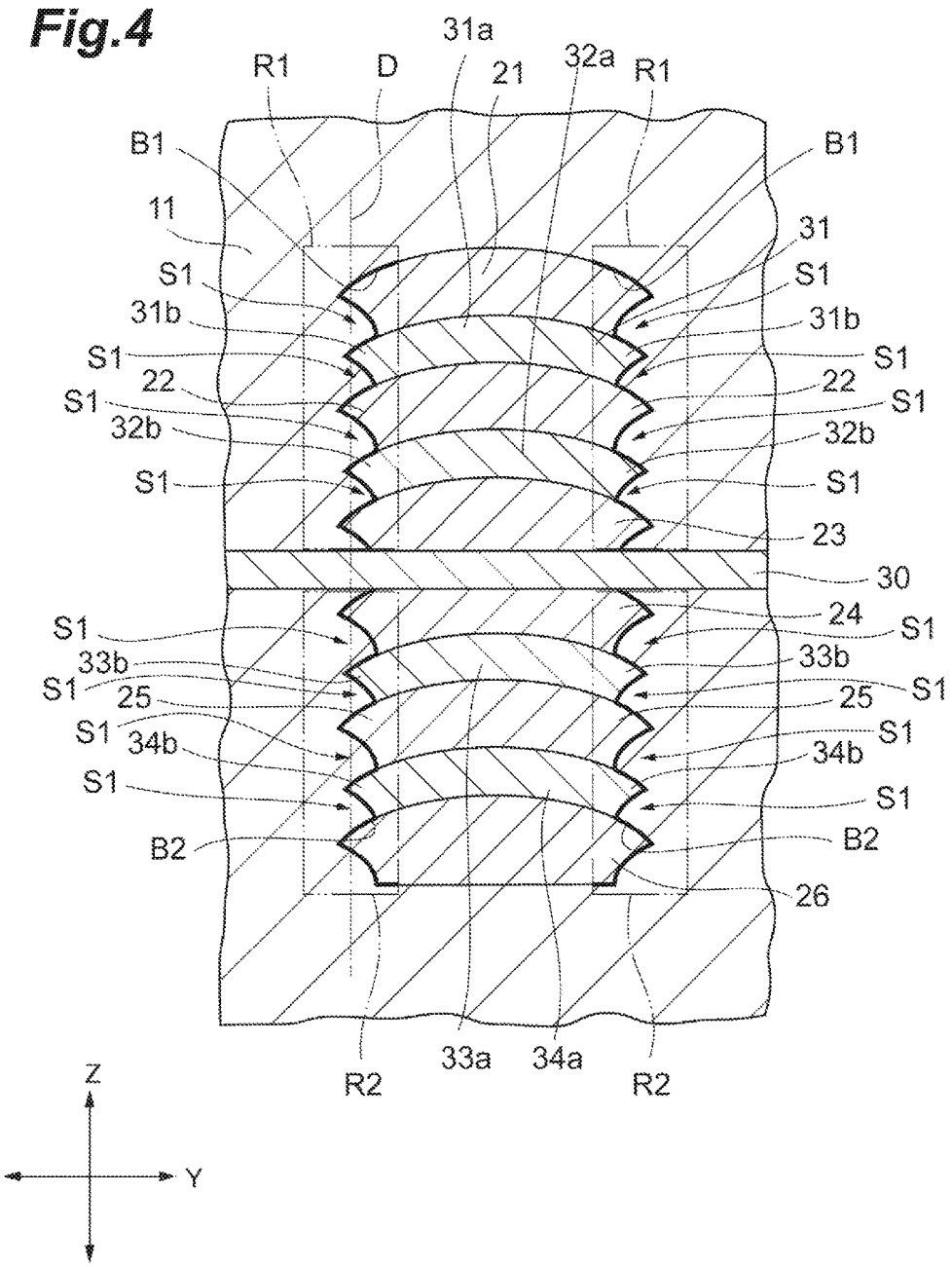
FIG. 4 is a cross-sectional view illustrating a boundary region illustrated in FIG. 3.

A configuration of a multilayer coil component according to a first embodiment will be described with reference to FIGS. 1 to 3. FIG. 1 is a perspective view illustrating the multilayer coil component according to the first embodiment. FIG. 2 is an exploded perspective view of the multilayer coil component illustrated in FIG. 1. FIG. 3 is a cross-sectional view of an element body taken along the line III to III of FIG. 1. FIG. 4 is a cross-sectional view illustrating a boundary region illustrated in FIG. 3. In FIG. 2, illustration of a magnetic portion and external electrodes is omitted. In FIG. 3, illustration of the external electrodes is omitted.

As illustrated in FIG. 1, a multilayer coil component 1 includes an element body 2 and a pair of external electrodes 4 and 5. The external electrodes 4 and 5 are disposed on both end portions of the element body 2.

The element body 2 has a rectangular parallelepiped shape. The element body 2 includes a pair of end surfaces 2*a* and 2*b* opposing each other and four side surfaces 2*c*, 2*d*, 2*e*, and 2*f*, as external surfaces thereof. The four side surfaces 2*c*, 2*d*, 2*e*, and 2*f* extend in a direction in which the end surface 2*a* and the end surface 2*b* oppose each other, to connect the pair of end surfaces 2*a* and 2*b*. The side surface 2*d* is a surface opposing an electronic apparatus (for example, a circuit board or an electronic component) not illustrated in the drawings, when the multilayer coil component 1 is mounted on the electronic apparatus.

A direction (X direction in the drawings) in which the end surface 2*a* and the end surface 2*b* oppose each other, a direction (Z direction in the drawings) in which the side surface 2*c* and the side surface 2*d* oppose each other, and a direction (Y direction in the drawings) in which the side surface 2*e* and the side surface 2*f* oppose each other are approximately orthogonal to each other. The rectangular parallelepiped shape includes a shape of a rectangular parallelepiped with chamfered corner portions and ridge portions, and a shape of a rectangular parallelepiped with rounded corner portions and ridge portions.

The element body 2 is configured by laminating a plurality of magnetic layers and includes a magnetic portion 11 (refer to FIG. 3). The plurality of magnetic layers are laminated in the direction in which the side surface 2*c* and the side surface 2*d* oppose each other. That is, a direction in which the plurality of magnetic layers are laminated coincides with the direction (Z direction in the drawings) in which the side surface 2*c* and the side surface 2*d* oppose each other. Hereinafter, the direction in which the plurality of magnetic layers are laminated (that is, the direction in which the side surface 2*c* and the side surface 2*d* oppose each other) is called the "Z direction". Each of the plurality of magnetic layers has an approximately rectangular shape. In the actual element body 2, the plurality of magnetic material layers is integrated in such a manner that inter-layer boundaries cannot be visualized.

The magnetic portion 11 is configured as a sintered body of magnetic paste including powder of a magnetic material (a Ni—Cu—Zn based ferrite material, a Ni—Cu—Zn—Mg based ferrite material, or a Ni—Cu based ferrite material), for example. That is, the element body 2 has magnetism. The magnetic paste may include powder such as a Fe alloy.

The external electrode 4 is disposed on the end surface 2*a* of the element body 2 and the external electrode 5 is disposed on the end surface 2*b* of the element body 2. That is, the external electrode 4 and the external electrode 5 are separated from each other in the direction in which the end surface 2*a* and the end surface 2*b* oppose each other. Each of the external electrodes 4 and 5 has an approximately rectangular shape in planar view and corners of the external electrodes 4 and 5 are rounded. The external electrodes 4 and 5 include a conductive material (for example, Ag or Pd). The external electrodes 4 and 5 are configured as sintered bodies of conductive paste including conductive metal powder (for example, Ag powder or Pd powder) and glass frit. Plating layer is formed on surfaces of the external electrodes 4 and 5 by electroplating. For example, the electroplating to be used is Ni plating and Sn plating.

The external electrode 4 includes five electrode portions of an electrode portion 4*a* located on the end surface 2*a*, an electrode portion 4*b* located on the side surface 2*d*, an electrode portion 4*c* located on the side surface 2*c*, an electrode portion 4*d* located on the side surface 2*e*, and an electrode portion 4*e* located on the side surface 2*f*. The electrode portion 4*a* covers an entire surface of the end surface 2*a*. The electrode portion 4*b* covers a part of the side surface 2*d*. The electrode portion 4*c* covers a part of the side surface 2*c*. The electrode portion 4*d* covers a part of the side surface 2*e*. The electrode portion 4*e* covers a part of the side surface 2*f*. The five electrode portions 4*a*, 4*b*, 4*c*, 4*d*, and 4*e* are integrally formed.

The external electrode 5 includes five electrode portions of an electrode portion 5*a* located on the end surface 2*b*, an electrode portion 5*b* located on the side surface 2*d*, an electrode portion 5*c* located on the side surface 2*c*, an electrode portion 5*d* located on the side surface 2*e*, and an electrode portion Se located on the side surface 2*f*. The electrode portion 5*a* covers an entire surface of the end surface 2*b*. The electrode portion 5*b* covers a part of the side surface 2*d*. The electrode portion 5*c* covers a part of the side surface 2*c*. The electrode portion 5*d* covers a part of the side surface 2*e*. The electrode portion 5*e* covers a part of the side surface 2*f*. The five electrode portions 5*a*, 5*b*, 5*c*, 5*d*, and 5*e* are integrally formed.

As illustrated in FIGS. 2 to 4, the multilayer coil component 1 includes a plurality of coil conductors 21, 22, 23, 24, 25, and 26 (a plurality of internal conductors), lead conductors 13 and 14, one magnetic gap layer 30, and a plurality of low-permeability layers 31, 32, 33, and 34, which are provided in the element body 2. In FIG. 2, the magnetic gap layer 30 and the individual low-permeability layers 31 to 34 are shown by dashed-dotted lines.

The coil conductors 21 to 26 include first conductor portions that are separated from each other in the Z direction (first direction) and overlap each other when viewed from the Z direction. One end portions and the other end portions of the coil conductors 21, 23, 25, and 26 are separated from each other in the X direction. One end portions and the other end portions of the coil conductors 22 and 24 are separated from each other in the Y direction. The coil conductors 21 to 26 adjacent to each other in the Z direction include the first conductor portions and second conductor portions not overlapping each other, when viewed from the Z direction. The end portions of the coil conductors 21 to 26 are connected by through-hole conductors 17. The through-hole conductors 17 are located between the end portions adjacent to each other in the Z direction.

An end portion 21*b* of the coil conductor 21 and an end portion 22*a* of the coil conductor 22 are connected by the through-hole conductor 17. An end portion 22*b* of the coil conductor 22 and an end portion 23*a* of the coil conductor 23 are connected by the through-hole conductor 17. An end portion 23*b* of the coil conductor 23 and an end portion 24*a* of the coil conductor 24 are connected by the through-hole conductor 17. An end portion 24*b* of the coil conductor 24 and an end portion 25*a* of the coil conductor 25 are connected by the through-hole conductor 17. An end portion 25*b* of the coil conductor 25 and an end portion 26*a* of the coil conductor 26 are connected by the through-hole conductor 17.

The coil conductors 21 to 26 are connected to each other via the through-hole conductor 17, so that a coil 20 is configured in the element body 2. That is, the multilayer coil component 1 includes the coil 20 provided in the element body 2. The coil 20 includes the plurality of coil conductors 21 to 26 that are separated from each other in the Z direction and are electrically connected to each other. An axial direction of the coil 20 is the Z direction. The end portion 21*a* of the coil conductor 21 corresponds to one end portion E1 of the coil 20, and the end portion 26*b* of the coil conductor 26 corresponds to the other end portion E2 of the coil 20.

The coil conductor 21 is disposed at a position closest to the side surface 2*c* of the element body 2 in the lamination direction among the plurality of coil conductors 21 to 26. In this embodiment, a conductor pattern of the coil conductor 21 and a conductor pattern of the lead conductor 13 are formed to be integrally connected. The lead conductor 13 connects the end portion 21*a* of the coil conductor 21 and the external electrode 4 and is exposed to the end surface 2*a* of the element body 2. The lead conductor 13 is connected to the electrode portion 4*a* covering the end surface 2*a*. The one end portion E1 of the coil 20 and the external electrode 4 are electrically connected via the lead conductor 13.

The coil conductor 26 is disposed at a position closest to the side surface 2*d* of the element body 2 in the lamination direction among the plurality of coil conductors 21 to 26. In this embodiment, a conductor pattern of the coil conductor 26 and a conductor pattern of the lead conductor 14 are formed to be integrally connected. The lead conductor 14 connects the end portion 26*b* of the coil conductor 26 and the external electrode 5 and is exposed to the end surface 2*b* of the element body 2. The lead conductor 14 is connected to the electrode portion 5*a* covering the end surface 2*b*. The other end portion E2 of the coil 20 and the external electrode 5 are electrically connected via the lead conductor 14.

Each of the coil conductors 21 to 26, the lead conductors 13 and 14, and the through-hole conductors 17 includes a conductive material (for example, Ag or Pd), for example. Each of the coil conductors 21 to 26, the lead conductors 13 and 14, and the through-hole conductors 17 is configured as a sintered body of conductive paste including conductive metal powder (for example, Ag powder or Pd powder).

The magnetic gap layer 30 is disposed between the coil conductor 23 and the coil conductor 24. The magnetic gap layer 30 has an approximately rectangular shape when viewed from the Z direction. The magnetic gap layer 30 extends to entirely cover a lamination surface along the Z direction, that is, a cross-section (surface extending in the X direction and the Y direction) crossing an axial direction of the coil 20 in the element body 2. A through-hole is formed in the magnetic gap layer 30. The through-hole conductor 17 to connect the coil conductor 23 and the coil conductor 24 is disposed in the through-hole.

The low-permeability layers 31 and 34 are disposed among the individual coil conductors 21 to 26 adjacent to each other in the Z direction. The low-permeability layers 31 to 34 are disposed along the first conductor portions of the corresponding coil conductors 21 to 26, when viewed from the Z direction. Each of the low-permeability layers 31 to 34 has a frame shape, for example.

The low-permeability layer 31 is disposed between the coil conductor 21 and the coil conductor 22. The low-permeability layer 31 contacts the first conductor portion of the coil conductor 21 overlapping the coil conductor 22 and the first conductor portion of the coil conductor 22 overlapping the coil conductor 21, when viewed from the Z direction. That is, the low-permeability layer 31 is disposed along the first conductor portion of the coil conductor 21 and the first conductor portion of the coil conductor 22. The low-permeability layer 31 contacts the second conductor portion of the coil conductor 21 not overlapping the coil conductor 22 and the second conductor portion of the coil conductor 22 not overlapping the coil conductor 21, when viewed from the Z direction. That is, the low-permeability layer 31 also overlaps a separation region where one end portion and the other end portion of the coil conductor 21 are separated from each other in the X direction and a separation region where one end portion and the other end portion of the coil conductor 22 are separated from each other in the Y direction, when viewed from the Z direction. The low-permeability layer 31 includes a contact portion 31*a* (first portion) that contacts the coil conductors 21 and 22 and a separation portion 31*b* (second portion) that is separated from the coil conductors 21 and 22 in the Z direction (refer to FIG. 4).

The low-permeability layer 32 is disposed between the coil conductor 22 and the coil conductor 23. The low-permeability layer 32 contacts the first conductor portion of the coil conductor 22 overlapping the coil conductor 23 and the first conductor portion of the coil conductor 23 overlapping the coil conductor 22, when viewed from the Z direction. That is, the low-permeability layer 32 is disposed along the first conductor portion of the coil conductor 22 and the first conductor portion of the coil conductor 23. The low-permeability layer 32 contacts the second conductor portion of the coil conductor 22 not overlapping the coil conductor 23 and the second conductor portion of the coil conductor 23 not overlapping the coil conductor 22, when viewed from the Z direction. That is, the low-permeability layer 32 also overlaps a separation region where one end portion and the other end portion of the coil conductor 22 are separated from each other in the Y direction and a separation region where one end portion and the other end portion of the coil conductor 23 are separated from each other in the X direction, when viewed from the Z direction. The low-permeability layer 32 includes a contact portion 32*a* (first portion) that contacts the coil conductors 22 and 23 and a separation portion 32*b* (second portion) that is separated from the coil conductors 22 and 23 in the Z direction (refer to FIG. 4).

The low-permeability layer 33 is disposed between the coil conductor 24 and the coil conductor 25. The low-permeability layer 33 contacts the first conductor portion of the coil conductor 24 overlapping the coil conductor 25 and the first conductor portion of the coil conductor 25 overlapping the coil conductor 24, when viewed from the Z direction. That is, the low-permeability layer 33 is disposed along the first conductor portion of the coil conductor 24 and the first conductor portion of the coil conductor 25. The low-permeability layer 33 contacts the second conductor portion of the coil conductor 24 not overlapping the coil conductor 25 and the second conductor portion of the coil conductor 25 not overlapping the coil conductor 24, when viewed from the Z direction. That is, the low-permeability layer 33 also overlaps a separation region where one end portion and the other end portion of the coil conductor 24 are separated from each other in the Y direction and a separation region where one end portion and the other end portion of the coil conductor 25 are separated from each other in the Z direction, when viewed from the Z direction. The low-permeability layer 33 includes a contact portion 33*a* (first portion) that contacts the coil conductors 24 and 25 and a separation portion 33*b* (second portion) that is separated from the coil conductors 24 and 25 in the Z direction (refer to FIG. 4).

The low-permeability layer 34 is disposed between the coil conductor 25 and the coil conductor 26. The low-permeability layer 34 contacts the first conductor portion of the coil conductor 25 overlapping the coil conductor 26 and the first conductor portion of the coil conductor 26 overlapping the coil conductor 25, when viewed from the Z direction. That is, the low-permeability layer 34 is disposed along the first conductor portion of the coil conductor 25 and the first conductor portion of the coil conductor 26. The low-permeability layer 34 contacts the second conductor portion of the coil conductor 25 not overlapping the coil conductor 26 and the second conductor portion of the coil conductor 26 not overlapping the coil conductor 25, when viewed from the Z direction. That is, the low-permeability layer 34 also overlaps a separation region where one end portion and the other end portion of the coil conductor 25 are separated from each other in the X direction and a separation region where one end portion and the other end portion of the coil conductor 26 are separated from each other in the X direction, when viewed from the Z direction. The low-permeability layer 34 includes a contact portion 34*a* (first portion) that contacts the coil conductors 25 and 26 and a separation portion 34*b* (second portion) that is separated from the coil conductors 25 and 26 in the Z direction (refer to FIG. 4).

Each of the magnetic gap layer 30 and the low-permeability layers 31 to 34 has permeability lower than permeability of the element body 2. The magnetic gap layer 30 and the low-permeability layers 31 to 34 include a weakly magnetic material having permeability lower than permeability of the magnetic portion 11 or a non-magnetic material not having magnetism, for example. In this embodiment, the magnetic gap layer 30 and the low-permeability layers 31 to 34 are configured as sintered bodies of non-magnetic paste including powder of a non-magnetic material (a Cu—Zn based ferrite material).

Because the magnetic gap layer 30 has non-magnetism, the magnetic gap layer 30 blocks magnetic flux generated around the entire coil 20. Therefore, generation of magnetic saturation is suppressed around the entire coil 20. Because the low-permeability layers 31 to 34 have non-magnetism and include the contact portions 31*a* to 34*a*, respectively, the individual low-permeability layers 31 to 34 block magnetic flux generated around the individual coil conductors 21 to 26. Therefore, the magnetic flux is hard to flow around the individual coil conductors 21 to 26. Generation of local magnetic saturation is suppressed around the individual coil conductors 21 to 26. As a result, generation of the magnetic saturation is suppressed in the multilayer coil component 1 and a direct-current superposition characteristic of the multilayer coil component 1 is improved.

As illustrated in FIG. 3, the plurality of coil conductors 21 to 26 have almost the same thickness Ta in the Z direction. The plurality of low-permeability layers 31 to 34 have almost the same thickness Tb in the Z direction. The thicknesses Tb of the low-permeability layers 31 to 34 are smaller than the thicknesses Ta of the coil conductors 21 to 26.

In a cross-section of the element body 2 along the Y direction and the Z direction, widths Wa of the coil conductors 21 to 26 in the Y direction and widths Wb of the low-permeability layers 31 to 34 in the Y direction are approximately the same. The widths Wb of the low-permeability layers 31 to 34 in the Y direction may be set to a value of a degree to which the magnetic flux in the vicinity of the coil conductors 21 to 26 can be blocked. The low-permeability layers 31 to 34 may not protrude from the coil conductors 21 to 26 or may protrude from the coil conductors 21 to 26, when viewed from the Z direction.

The element body 2 includes element body regions S1 (first element body regions) (refer to FIG. 4). The element body regions S1 are interposed among the separation portions 31*b* to 34*b* of the low-permeability layers 31 to 34 and the coil conductors 21 to 26 adjacent to the separation portions 31*b* to 34*b* in the Z direction. That is, the element body regions S1 are located between the separation portion 31*b* and the coil conductor 21, between the separation portion 31*b* and the coil conductor 22, between the separation portion 32*b* and the coil conductor 22, between the separation portion 32*b* and the coil conductor 23, between the separation portion 33*b* and the coil conductor 24, between the separation portion 33*b* and the coil conductor 25, between the separation portion 34*b* and the coil conductor 25, and between the separation portion 34*b* and the coil conductor 26.

The magnetic material portion 11 includes a plurality of boundary surfaces 11*a* for the coil conductors 21 to 26 and a plurality of boundary surfaces 11*b* for the low-permeability layers 31 to 34. The element body 2 includes boundary regions R1 and R2 where the boundary surface 11*a* and the boundary surface 11*b* are alternately arranged in the Z direction.

The boundary region R1 is located closer to the side surface 2*c* of the element body 2 than the magnetic gap layer 30 in the Z direction. The boundary region R1 includes the separation portions 31*b* and 32*b* of the low-permeability layers 31 and 32. The boundary region R1 includes the individual boundary surfaces 11*a* of the magnetic material portion 11 for the coil conductors 21 to 23 and the individual boundary surfaces 11*b* of the magnetic material portion 11 for the low-permeability layers 31 and 32. In the boundary region R1, the boundary surface 11*a* and the boundary surface 11*b* are alternately arranged, so that a boundary B1 (refer to FIG. 4) between the coil conductors 21 to 23 and low-permeability layers 31 and 32 and the element body 2 is formed. That is, the boundary region R1 includes the boundary B1.

The boundary region R2 is located closer to the side surface 2*d* of the element body 2 than the magnetic gap layer 30 in the Z direction. The boundary region R2 includes the separation portions 33*b* and 34*b* of the low-permeability layers 33 and 34. The boundary region R2 includes the individual boundary surfaces 11*a* of the magnetic material portion 11 for the coil conductors 24 to 26 and the individual boundary surfaces 11*b* of the magnetic material portion 11 for the low-permeability layers 33 and 34. In the boundary region R2, the boundary surface 11*a* and the boundary surface 11*b* are alternately arranged, so that a boundary B2 (refer to FIG. 4) between the coil conductors 24 to 26 and low-permeability layers 33 and 34 and the element body 2 is formed. That is, the boundary region R2 includes the boundary B2.

In the boundary regions R1 and R2, the element body regions S1 are located between the individual coil conductors 21 to 26 and the individual low-permeability layers 31 to 34 alternately arranged in the Z direction. In the boundary region R1, the element body region S1 is located between the coil conductor 21 and the low-permeability layer 31 and the element body region S1 is located between the coil conductor 22 and the low-permeability layer 32, in the Z direction. In the boundary region R1, the coil conductors 21 to 23, the low-permeability layers 31 and 32, and the element body regions S1 are arranged on a virtual axis D (refer to FIG. 4) along the Z direction, in order of the coil conductor 21, the element body region S1, the low-permeability layer 31, the element body region S1, the coil conductor 22, the element body region S1, the low-permeability layer 32, the element body region S1, and the coil conductor 23. In the boundary region R1, the boundary surface 11*a* and the boundary surface 11*b* are arranged in the Z direction to configure saw teeth extending in the Z direction, in a virtual cross-section along the Y direction and the Z direction. That is, the boundary B1 (refer to FIG. 4) between the coil conductors 21 to 23 and low-permeability layers 31 and 32 and the element body 2 is not formed along the Z direction and includes a surface crossing the Z direction.

In the boundary region R2, the element body region S1 is located between the coil conductor 24 and the coil conductor 25 and the element body region S1 is located between the coil conductor 25 and the coil conductor 26, in the Z direction. In the boundary region R2, the coil conductors 24 to 26, the low-permeability layers 33 and 34, and the element body regions S1 are arranged on the virtual axis D (refer to FIG. 4) along the Z direction, in order of the coil conductor 24, the element body region S1, the low-permeability layer 33, the element body region S1, the coil conductor 25, the element body region S1, the low-permeability layer 34, the element body region S1, and the coil conductor 26. In the boundary region R2, the boundary surface 11*a* and the boundary surface 11*b* are arranged in the Z direction to configure saw teeth extending in the Z direction, in the virtual cross-section along the Y direction and the Z direction. That is, the boundary B2 (refer to FIG. 4) between the coil conductors 24 to 26 and low-permeability layers 33 and 34 and the element body 2 is not formed along the Z direction and includes a surface crossing the Z direction.

Next, a process for manufacturing the multilayer coil component 1 will be described. The multilayer coil component 1 is manufactured as follows. First, a laminate body is obtained by sequentially laminating a magnetic paste pattern to configure the magnetic material portion 11, a conductive past pattern to configure the coil conductors 21 to 26, the lead conductors 13 and 14, and the through-hole conductors 17, and a non-magnetic paste pattern to configure the magnetic gap layer 30 and the low-permeability layers 31 to 34 by a printing method.

The magnetic paste pattern is formed by applying magnetic paste and drying the magnetic paste. The magnetic paste is manufactured by mixing powder of the magnetic material and an organic solvent and an organic binder. The conductive paste pattern is formed by applying conductive paste and drying the conductive paste. The conductive paste is manufactured by mixing the conductive metal powder and the organic solvent and the organic binder. The non-magnetic paste pattern is formed by applying non-magnetic paste and drying the non-magnetic paste. The non-magnetic paste is manufactured by mixing powder of the non-magnetic material or the weakly magnetic material and the organic solvent and the organic binder. A lamination process of the magnetic paste pattern, the conductive paste pattern, and the non-magnetic paste pattern to form the boundary regions R1 and R2 will be described in detail below.

Next, a plurality of green chips are obtained by cutting the laminate body. The green chip has a size corresponding to a size of the element body 2. Next, barrel polishing is performed on the obtained green chip. As a result, the green chip in which a corner portion or a ridge portion is rounded is obtained. Next, the green chip on which the barrel polishing has been performed is fired under a predetermined condition. As a result, the magnetic portion 11 is configured as a sintered body of the magnetic paste pattern and the element body 2 is obtained. The coil conductors 21 to 26, the lead conductors 13 and 14, and the through-hole conductors 17 are configured as sintered bodies of the conductive paste pattern. The magnetic gap layer 30 and the low-permeability layers 31 to 34 are configured as sintered bodies of the non-magnetic paste pattern. That is, the element body 2 includes the coil conductors 21 to 26, the through-hole conductors 17, the magnetic gap layer 30, and the low-permeability layers 31 to 34.

Next, conductive paste for the external electrodes 4 and 5 is applied to an external surface of the element body 2 and the applied conductive paste is thermally treated under a predetermined condition. As a result, the external electrodes 4 and 5 are formed in the element body 2. Then, plating is performed on surfaces of the external electrodes 4 and 5. In this way, the multilayer coil component 1 is obtained.

Hereinafter, a lamination process of the magnetic paste pattern, the conductive paste pattern, and the non-magnetic paste pattern to form the boundary region R1 will be described in detail with reference to the FIGS. 5A to 8B. Because a lamination process to form the boundary region R2 is the same as the lamination process to form the boundary region R1, description thereof is omitted. In FIGS. 5A to 8B, only a part of a magnetic green sheet G to configure the magnetic portion 11 is illustrated.

Figure 5B:
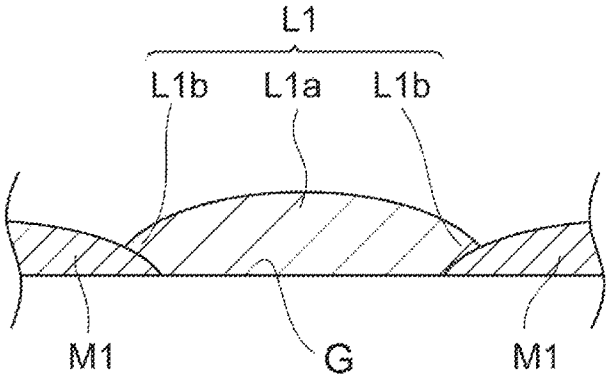
FIGS. 5A and 5B are diagrams illustrating a lamination process for forming the boundary region illustrated in FIG. 3.
Figure 5A:
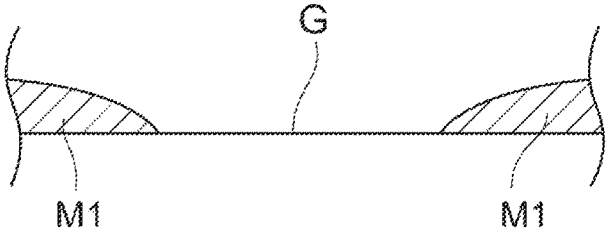

FIGS. 5A to 8B are diagrams illustrating the lamination process to form the boundary regions. First, as illustrated in FIG. 5A, the magnetic paste is printed on a surface of the magnetic green sheet G formed by printing the magnetic paste in a sheet shape. At this time, the magnetic paste is applied in such a manner that a predetermined margin region (that is, a region where the magnetic paste is not printed) is formed. A shape of the predetermined margin region corresponds to a shape of a conductive paste pattern L1 (refer to FIG. 5B) to configure the coil conductor 21. As a result, magnetic paste patterns M1 to configure the magnetic material portion 11 and the predetermined margin region located between the magnetic paste patterns M1 are formed on the magnetic green sheet G.

Next, as illustrated in FIG. 5B, the conductive paste is printed so as to be filled into the margin region located between the magnetic paste patterns M1. As a result, the conductive paste pattern L1 to configure the coil conductor 21 is formed on the magnetic green sheet G The conductive paste pattern L1 includes a central portion L1*a* located on the surface of the magnetic green sheet G and boundary portions L1*b* that are located on surfaces of the magnetic paste patterns M1. The surfaces of the magnetic paste patterns M1 and the surface of the conductive paste pattern L1 are not flat and the conductive paste pattern L1 rises as compared with the magnetic paste patterns M1.

Figure 6B:
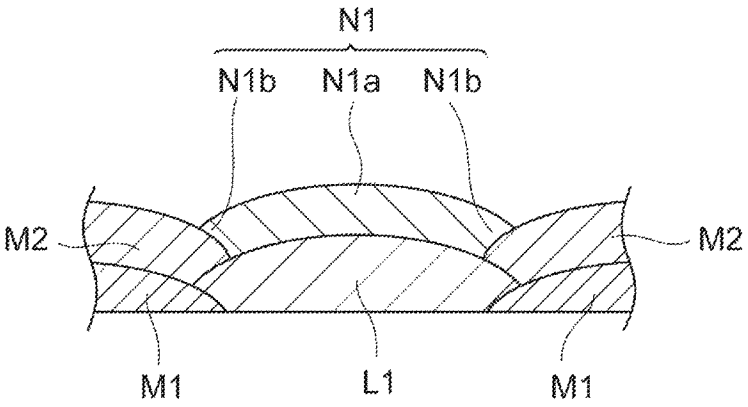
FIGS. 6A and 6B are diagrams illustrating a lamination process for forming the boundary region illustrated in FIG. 3.
Figure 6A:
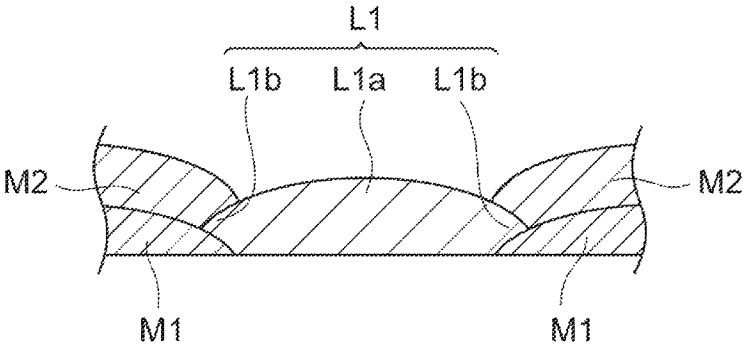

Next, as illustrated in FIG. 6A, the magnetic paste is printed on the surfaces of the magnetic paste patterns M1. At this time, the magnetic paste is printed in such a manner that a predetermined margin region is formed. A shape of the predetermined margin region corresponds to a shape of a non-magnetic paste pattern N1 (refer to FIG. 6B) to configure the low-permeability layer 31. As a result, magnetic paste patterns M2 to configure the magnetic material portion 11 and the predetermined margin region located between the magnetic paste patterns M2 are formed on the magnetic paste patterns M1 and the conductive paste pattern L1. The predetermined margin region is located on the central portion L1*a* of the conductive paste pattern L1. The boundary portions L1*b* of the conductive paste pattern L1 are interposed between the magnetic paste patterns M1 and the magnetic paste patterns M2.

Next, as illustrated in FIG. 6B, the non-magnetic paste is printed so as to be filled into the margin region located between the magnetic paste patterns M2. As a result, the non-magnetic paste pattern N1 to configure the low-permeability layer 31 is formed on the conductive paste pattern L1. The non-magnetic paste pattern N1 includes a central portion N1*a* that is located on the surface of the conductive paste pattern L1 and boundary portions N1*b* that are located on the surfaces of the magnetic paste patterns M2. The surfaces of the magnetic paste patterns M2 and the surface of the non-magnetic paste pattern N1 are nearly flat.

Figure 7B:
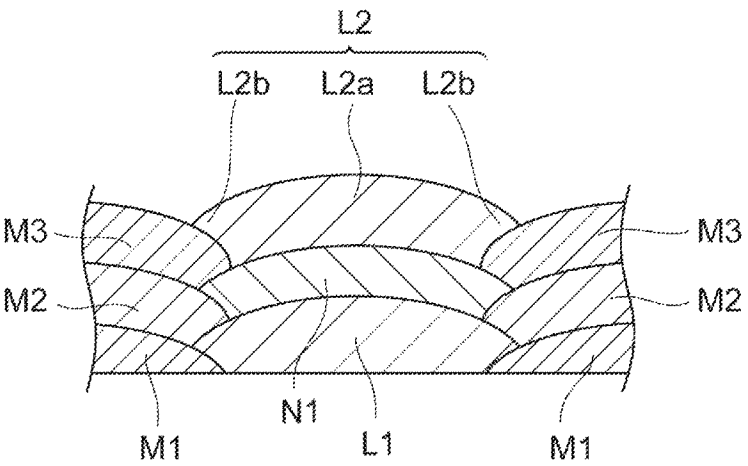
FIGS. 7A and 7B are diagrams illustrating a lamination process for forming the boundary region illustrated in FIG. 3.
Figure 7A:
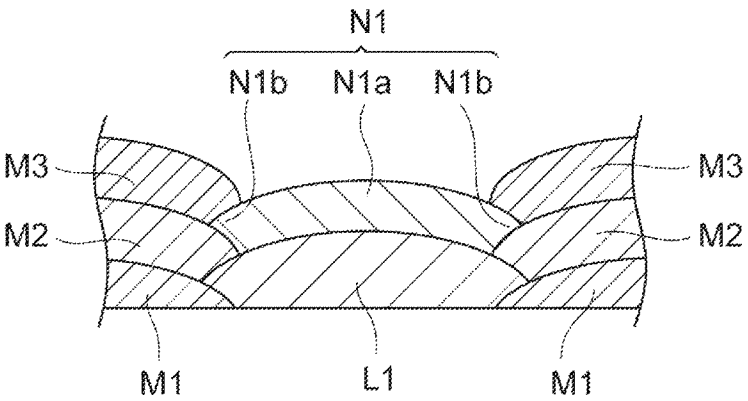

Next, as illustrated in FIG. 7A, the magnetic paste is printed on the surfaces of the magnetic paste patterns M2. At this time, the magnetic paste is printed in such a manner that a predetermined margin region is formed. A shape of the predetermined margin region corresponds to a shape of a conductive paste pattern L2 (refer to FIG. 7B) to configure the coil conductor 22. As a result, magnetic paste patterns M3 to configure the magnetic material portion 11 and the predetermined margin region located between the magnetic paste patterns M3 are formed on the magnetic paste patterns M2 and the non-magnetic paste pattern N1. The predetermined margin region is located on the central portion N1*a* of the non-magnetic paste pattern N1. The boundary portions N1*b* of the non-magnetic paste pattern N1 are interposed between the magnetic paste patterns M2 and the magnetic paste patterns M3.

Next, as illustrated in FIG. 7B, the conductive paste is printed so as to be filled into the margin region located between the magnetic paste patterns M3. As a result, the conductive paste pattern L2 to configure the coil conductor 22 is formed on the non-magnetic paste pattern N1. The conductive paste pattern L2 includes a central portion L2*a* that is located on the surface of the non-magnetic paste pattern N1 and boundary portions L2*b* that are located on the surfaces of the magnetic paste patterns M3. The surfaces of the magnetic paste patterns M3 and the surface of the conductive paste pattern L2 are not flat and the conductive paste pattern L2 rises as compared with the magnetic paste patterns M3.

Figure 8B:
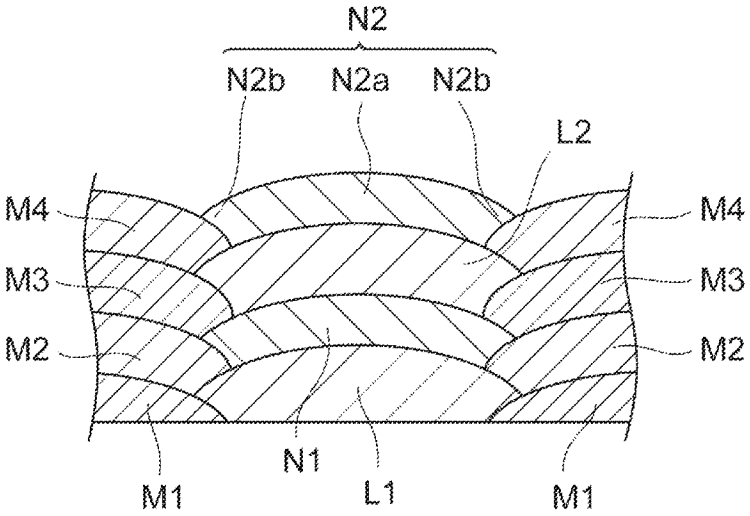
FIGS. 8A and 8B are diagrams illustrating a lamination process for forming the boundary region illustrated in FIG. 3.
Figure 8A:
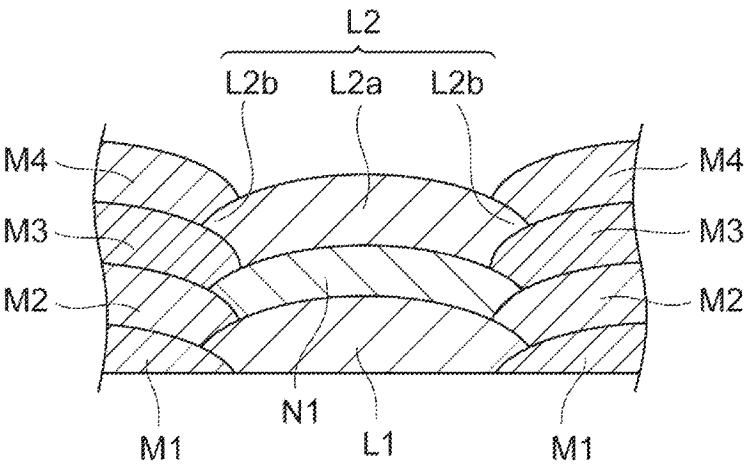

Next, as illustrated in FIG. 8A, magnetic paste patterns M4 are printed on the surfaces of the magnetic paste patterns M3. At this time, the magnetic paste is printed in such a manner that a predetermined margin region is formed. A shape of the predetermined margin region corresponds to a shape of a non-magnetic paste pattern N2 (refer to FIG. 8B) to configure the low-permeability layer 32. As a result, the magnetic paste patterns M4 to configure the magnetic material portion 11 and the predetermined margin region located between the magnetic paste patterns M4 are formed on the magnetic paste patterns M3 and the conductive paste pattern L2. The predetermined margin region is located on the central portion L2*a* of the conductive paste pattern L2. The boundary portions L2*b* of the conductive paste pattern L2 are interposed between the magnetic paste patterns M3 and the magnetic paste patterns M4.

Next, as illustrated in FIG. 8B, the non-magnetic paste is printed so as to be filled into the margin region located between the magnetic paste patterns M4. As a result, the non-magnetic paste pattern N2 to configure the low-permeability layer 32 is formed on the conductive paste pattern L2. The non-magnetic paste pattern N2 includes a central portion N2*a* that is located on the surface of the conductive paste pattern L2 and boundary portions N2*b* that are located on the surfaces of the magnetic paste patterns M4. The surfaces of the magnetic paste patterns M4 and the surface of the non-magnetic paste pattern N2 are nearly flat.

Then, the same process as the process illustrated in FIGS. 7A and 7B is repeated. That is, the magnetic paste to configure the magnetic material portion 11 is printed on the surfaces of the magnetic paste patterns M4 in such a manner that a predetermined margin region is formed. The conductive paste to configure the coil conductor 23 is printed so as to be filled into the formed margin region. In this way, a portion corresponding to the boundary region R1, that is, a portion becoming the boundary region R1 by firing after the lamination is formed. A portion corresponding to the boundary region R2, that is, a portion becoming the boundary region R2 by firing after the lamination is also obtained by the same lamination process as the lamination process in the portion corresponding to the boundary region R1.

In the multilayer coil component 1 according to the first embodiment, the low-permeability layers 31 to 34 are disposed between the individual coil conductors 21 to 26 adjacent to each other in the Z direction. Each of the low-permeability layers 31 to 34 has the permeability lower than the permeability of the element body 2 and the low-permeability layers 31 to 34 include the contact portions 31*a* to 34*a* contacting the coil conductors 21 to 26, respectively. For this reason, the magnetic flux generated around the individual coil conductors 21 to 26 in the element body 2 is blocked by the contact portions 31*a* to 34*a*. As a result, generation of the magnetic saturation is suppressed and the direct-current superposition characteristic of the multilayer coil component 1 is improved.

The low-permeability layers 31 to 34 include the separation portions 31*b* to 34*b*, respectively. The element body regions S1 are interposed between the separation portions 31*b* to 34*b* and the coil conductors 21 to 26. Therefore, the boundaries B1 and B2 between the coil conductors 21 to 26 and low-permeability layers 31 to 34 and the element body 2 are not formed along the Z direction and include the surfaces crossing the Z direction. For this reason, the boundaries B1 and B2 between the coil conductors 21 to 26 and low-permeability layers 31 to 34 and the element body 2 function as resistances against a shearing stress along the Z direction and the shearing stress along the Z direction is dispersed in a direction crossing the Z direction. As a result, even when the shearing stress along the Z direction is generated, a crack is hard to be generated in the element body 2. By the above configuration, in the multilayer coil component 1, the direct-current superposition characteristic is improved and generation of the crack is suppressed.

In the multilayer coil component 1 according to this embodiment, the thicknesses Tb of the low-permeability layers 31 to 34 are smaller than the thicknesses Ta of the coil conductors 21 to 26. For this reason, in the same element body 2, a region occupied by the low-permeability layers 31 to 34 in the Z direction is narrower than a region occupied by the coil conductors 21 to 26 in the Z direction. That is, the coil 20 can be efficiently formed by increasing the region occupied by the coil conductors 21 to 26 in the element body 2.

Second Embodiment

Figure 9:
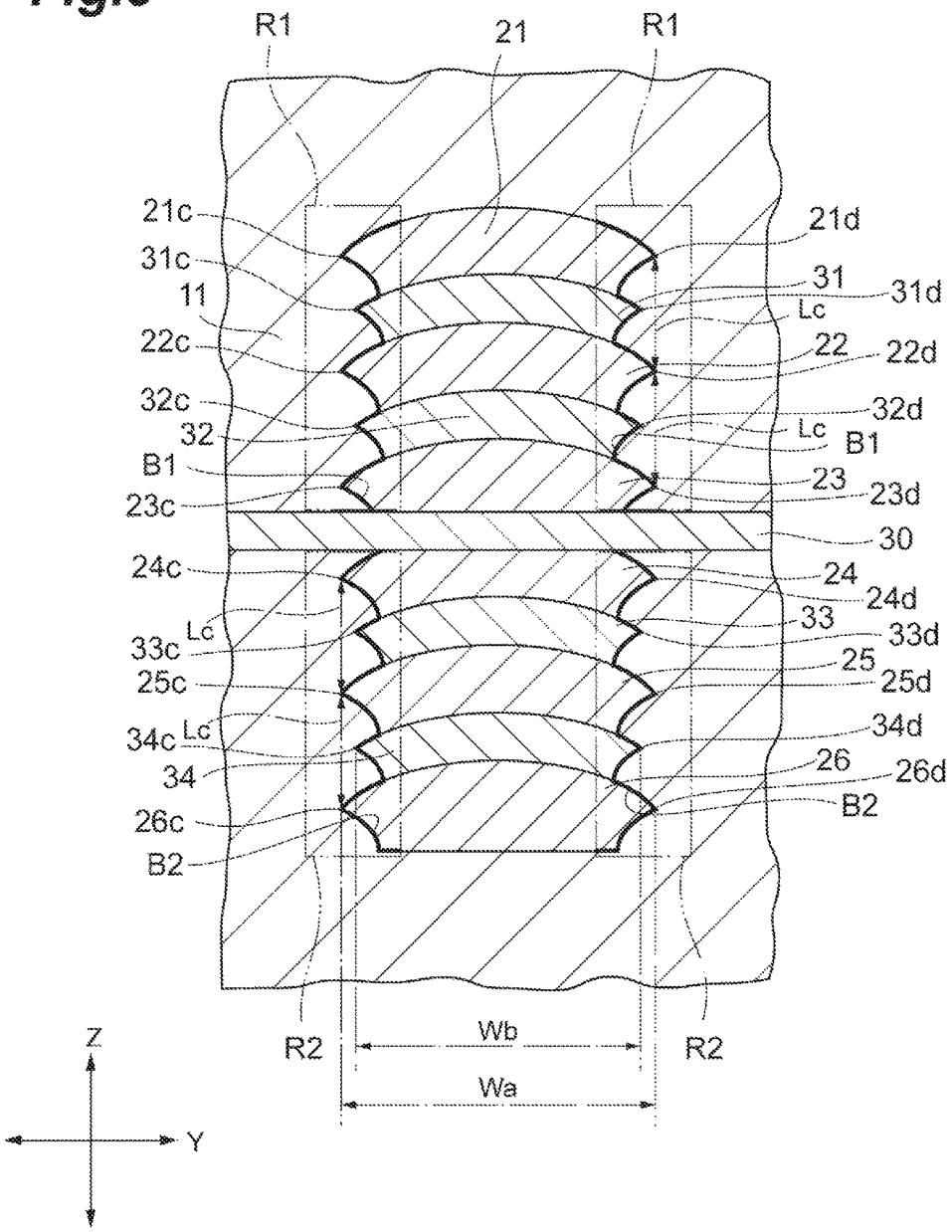
FIG. 9 is a cross-sectional view illustrating a boundary region of a multilayer coil component according to a second embodiment.

Next, a multilayer coil component according to a second embodiment will be described with reference to FIG. 9. FIG. 9 is a cross-sectional view illustrating boundary regions of the multilayer coil component according to the second embodiment. FIG. 9 corresponds to FIG. 4.

Although not illustrated in the drawings, the multilayer coil component according to the second embodiment includes an element body 2, a pair of external electrodes 4 and 5 (refer to FIG. 1), a plurality of coil conductors 21 to 26 (refer to FIGS. 2 and 3), a plurality of lead conductors 13 and 14 (refer to FIGS. 2 and 3), one magnetic gap layer 30 (refer to FIGS. 2 and 3), and a plurality of low-permeability layers 31 to 34, similar to the multilayer coil component 1 according to the first embodiment.

Similar to the first embodiment, the low-permeability layers 31 to 34 include contact portions 31*a* to 34*a* and separation portions 31*b* to 34*b*, respectively, and the element body 2 includes a plurality of element body regions S1 (refer to FIG. 4). In boundary regions R1 and R2, the element body regions S1 are interposed among the low-permeability layers 31 to 34 and the coil conductors 21 to 26 in a Z direction. In the boundary regions R1 and R2, boundary surfaces 11*a* and 11*b* are arranged in the Z direction to configure saw teeth extending in the Z direction. That is, boundaries B1 and B2 are not formed along the Z direction and include surfaces crossing the Z direction.

As illustrated in FIG. 9, the multilayer coil component according to the second embodiment is different from the multilayer coil component 1 in that the low-permeability layers 32 to 34 are located inside the coil conductors 21 to 26, when viewed from the Z direction. Lateral end portions 31*c*, 32*c*, 33*c*, and 34*c* of one side of the low-permeability layers 31 to 34 are located inside lateral end portions 21*c*, 22*c*, 23*c*, 24*c*, 25*c*, and 26*c* of one side of the coil conductors 21 to 26, in a Y direction in the element body 2. Lateral end portions 31*d*, 32*d*, 33*d*, and 34*d* of the other side of the low-permeability layers 31 to 34 are located inside lateral end portions 21*d*, 22*d*, 23*d*, 24*d*, 25*d*, and 26*d* of the other side of the coil conductors 21 to 26, in the Y direction in the element body 2.

In a cross-section along the Y direction and the Z direction, widths Wb of the low-permeability layers 31 to 34 in the Y direction are smaller than widths Wa of the coil conductors 21 to 26 in the Y direction. The widths Wb of the low-permeability layers 31 to 34 are set to a value of a degree to which magnetic flux around the coil conductors 21 to 26 can be blocked. Because the width Wb is smaller than the width Wa, regions Lc where a magnetic material portion 11 is interposed between the coil conductors 21 to 26 adjacent to each other in the Z direction without interposing the low-permeability layers 31 to 34 are formed at outsides of the low-permeability layers 31 to 34 and insides of the coil conductors 21 to 26 when viewed from the Z direction. In the regions Lc, the magnetic material portion configured by a material having the same heat shrinkage factor continuously exists.

Even in the multilayer coil component according to the second embodiment, the magnetic flux generated around the individual coil conductors 21 to 26 in the element body 2 is blocked by the contact portions 31*a* to 34*a*. As a result, generation of magnetic saturation is suppressed and a direct-current superposition characteristic of the multilayer coil component 1 is improved. The boundaries B1 and B2 between the coil conductors 21 to 26 and low-permeability layers 31 to 34 and the element body 2 are not formed along the Z direction and include the surfaces crossing the Z direction. For this reason, the boundaries B1 and B2 function as resistances against a shearing stress along the Z direction and the shearing stress along the Z direction is dispersed in a direction crossing the Z direction. As a result, even when the shearing stress along the Z direction is generated, a crack is hard to be generated in the element body 2. By the above configuration, even in the multilayer coil component according to the second embodiment, the direct-current superposition characteristic is improved and generation of the crack is suppressed.

In the multilayer coil component according to the second embodiment, the regions Lc are formed at the outsides of the low-permeability layers 31 to 34 and the insides of the coil conductors 21 to 26 when viewed from the Z direction. The regions Lc continuously exist in the Z direction without including boundaries with the low-permeability layers 31 to 34. For this reason, even when the shearing stress along the Z direction is generated, the regions Lc are hard to be sheared. In the multilayer coil component according to the second embodiment, the regions Lc are formed, so that generation of the crack is further suppressed.

Third Embodiment

Figure 10:
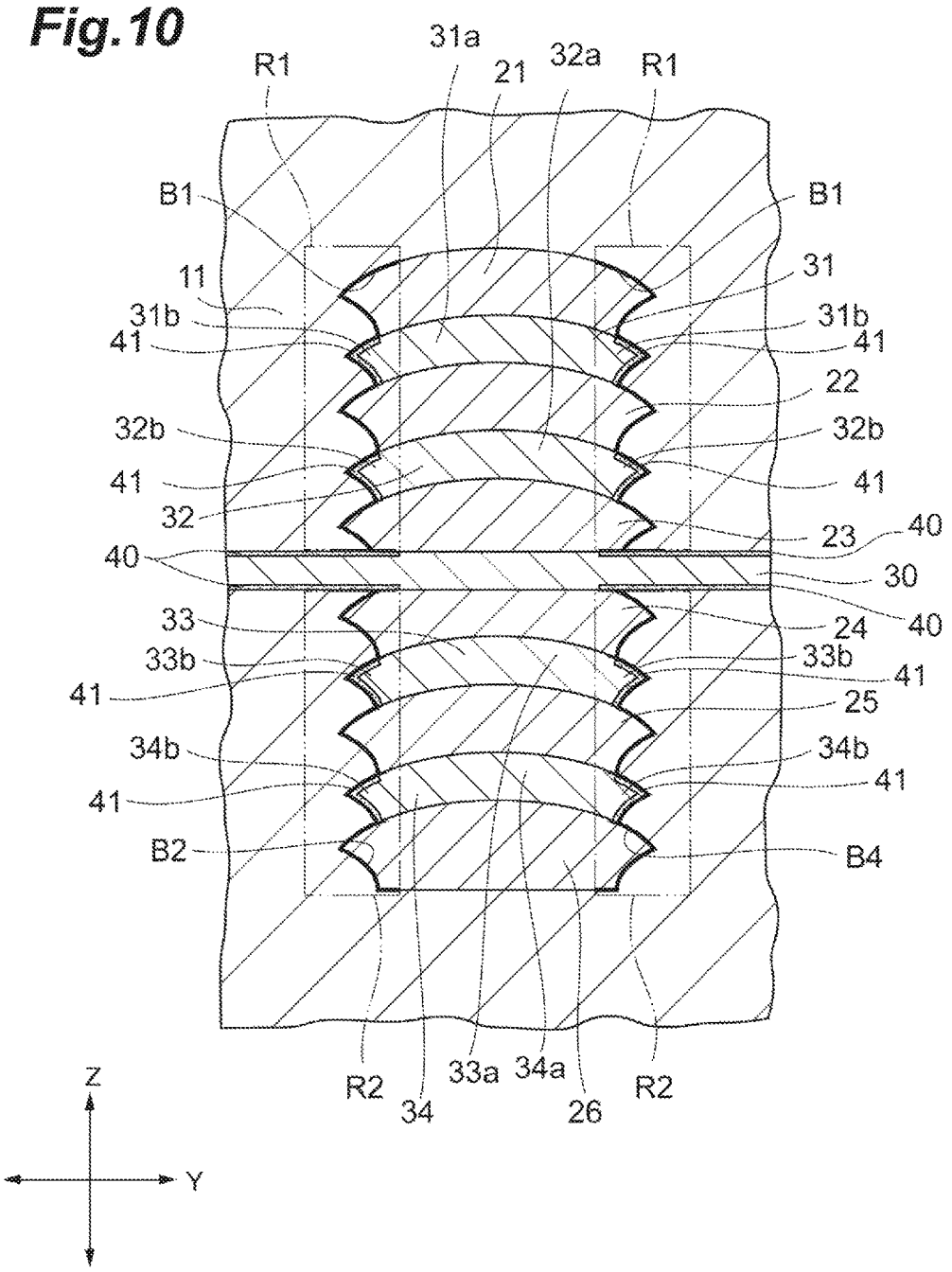
FIG. 10 is a cross-sectional view illustrating a boundary region of a multilayer coil component according to a third embodiment.

Next, a multilayer coil component according to a third embodiment will be described with reference to FIG. 10. FIG. 10 is a cross-sectional view illustrating boundary regions of the multilayer coil component according to the third embodiment. FIG. 10 corresponds to FIG. 4.

Although not illustrated in the drawings, the multilayer coil component according to the third embodiment includes an element body 2, a pair of external electrodes 4 and 5 (refer to FIG. 1), a plurality of coil conductors 21 to 26 (refer to FIGS. 2 and 3), a plurality of lead conductors 13 and 14 (refer to FIGS. 2 and 3), one magnetic gap layer 30 (refer to FIGS. 2 and 3), and a plurality of low-permeability layers 31 to 34, similar to the multilayer coil component 1 according to the first embodiment.

Similar to the first embodiment, the low-permeability layers 31 to 34 include contact portions 31*a* to 34*a* and separation portions 31*b* to 34*b*, respectively, and the element body 2 includes a plurality of element body regions S1 (refer to FIG. 4). In boundary regions R1 and R2, the element body regions S1 are interposed among the low-permeability layers 31 to 34 and the coil conductors 21 to 26 in a Z direction. In the boundary regions R1 and R2, boundary surfaces 11*a* and 11*b* are arranged in the Z direction to configure saw teeth extending in the Z direction. That is, boundaries B1 and B2 are not formed along the Z direction and include surfaces crossing the Z direction.

As illustrated in FIG. 10, the multilayer coil component according to the third embodiment is different from the multilayer coil component 1 in that diffusion layers 40 and 41 are formed in the magnetic gap layer 30 and the low-permeability layers 32 to 34. In the third embodiment, the diffusion layers 40 and 41 are regions in which Ni to be a part of magnetic materials included in the element body 2 diffuses. Each of the diffusion layers 40 and 41 has permeability higher than permeability of the element body 2. The diffusion layers 40 are formed on an entire boundary surface between the magnetic gap layer 30 and the element body 2. The diffusion layers 41 are formed on the sides of the separation portions 31*b* to 34*b* of the low-permeability layers 31 to 34.

Even in the multilayer coil component according to the third embodiment, a direct-current superposition characteristic is improved and generation of a crack is suppressed, similar to the first and second embodiments.

In the multilayer coil component according to this embodiment, the diffusion layers 41 are formed, so that a change of materials at the boundaries of the element body 2 and the low-permeability layers 31 to 34 is gradual, and joining strength of the element body 2 and the low-permeability layers 31 to 34 is increased.

Fourth Embodiment

Figure 11:
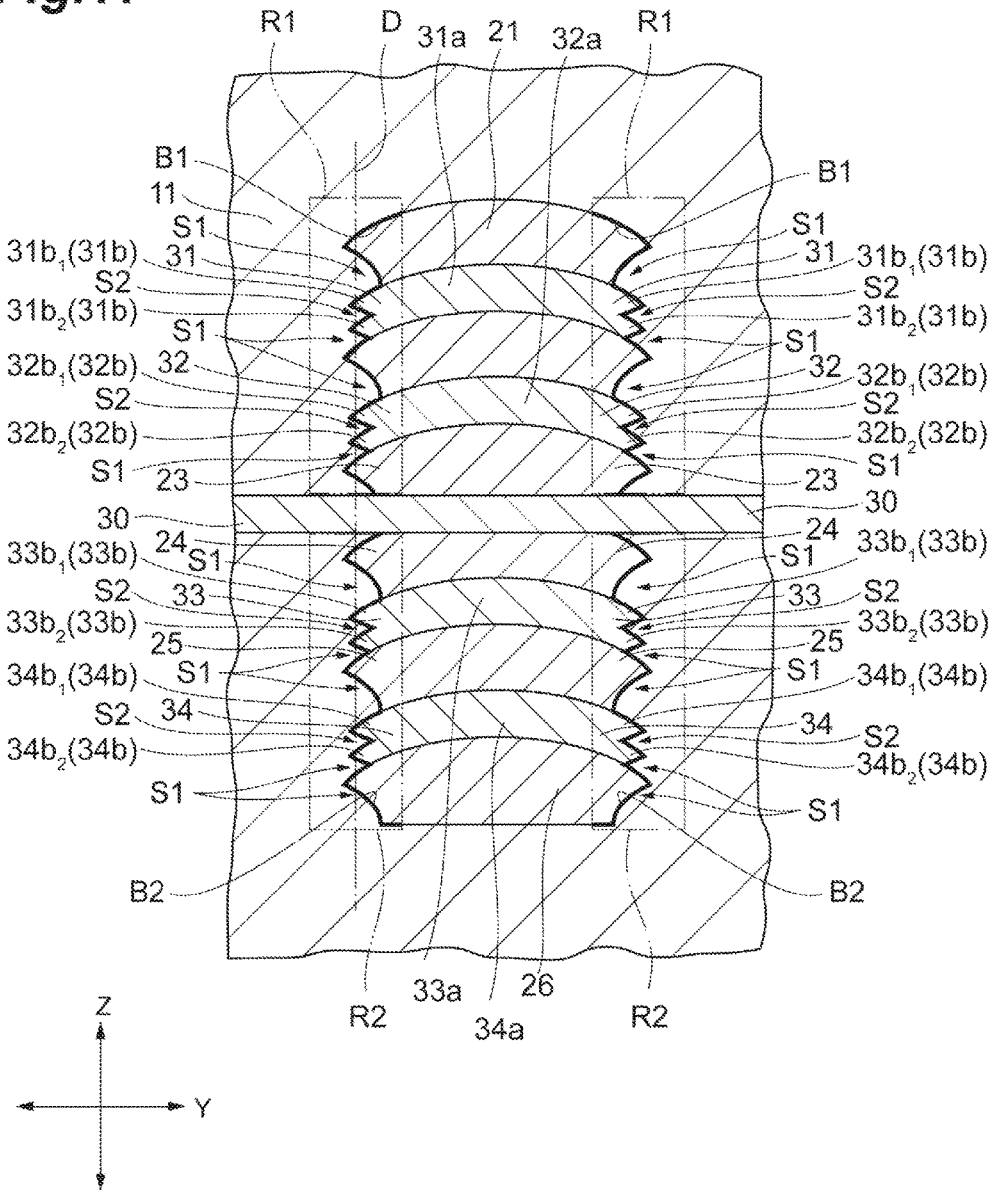
FIG. 11 is a cross-sectional view illustrating a boundary region of a multilayer coil component according to a fourth embodiment.

Next, a multilayer coil component according to a fourth embodiment will be described with reference to FIG. 11. FIG. 11 is a cross-sectional view illustrating boundary regions of the multilayer coil component according to the fourth embodiment. FIG. 11 corresponds to FIG. 4.

Although not illustrated in the drawings, the multilayer coil component according to the fourth embodiment includes an element body 2, a pair of external electrodes 4 and 5 (refer to FIG. 1), a plurality of coil conductors 21 to 26 (refer to FIGS. 2 and 3), a plurality of lead conductors 13 and 14 (refer to FIGS. 2 and 3), one magnetic gap layer 30 (refer to FIGS. 2 and 3), and a plurality of low-permeability layers 31 to 34, similar to the multilayer coil component 1 according to the first embodiment.

Similar to the first embodiment, the low-permeability layers 31 to 34 include contact portions 31*a* to 34*a* and separation portions 31*b* to 34*b*, respectively, and the element body 2 includes a plurality of element body regions S1 (refer to FIG. 4). In boundary regions R1 and R2, the element body regions S1 are interposed among the low-permeability layers 31 to 34 and the coil conductors 21 to 26 in a Z direction. In the boundary regions R1 and R2, boundary surfaces 11*a* and 11*b* are arranged in the Z direction to configure saw teeth extending in the Z direction. That is, boundaries B1 and B2 are not formed along the Z direction and include surfaces crossing the Z direction.

As illustrated in FIG. 11, the multilayer coil component according to the fourth embodiment is different from the multilayer coil component 1 in that the low-permeability layers 31 to 34 include a plurality of separation portions 31*b* to 34*b* and the element body 2 includes the element body regions S1 and element body regions S2 (second element body regions).

The low-permeability layers 31 to 34 include the plurality of separation portions 31*b* to 34*b* between the individual coil conductors 21 to 26 adjacent to each other. The individual separation portions 31*b* to 34*b* are arranged in the Z direction. The low-permeability layer 31 includes a separation portion $\mathbf{31}b_1$ and a separation portion $\mathbf{31}b_2$ between the coil conductor 21 and the coil conductor 22. The separation portion $\mathbf{31}b_1$ and the separation portion $\mathbf{31}b_2$ are adjacent to each other in the Z direction. The low-permeability layer 32 includes a separation portion $\mathbf{32}b_1$ and a separation portion $\mathbf{32}b_2$ between the coil conductor 22 and the coil conductor 23. The separation portion $\mathbf{32}b_1$ and the separation portion $\mathbf{32}b_2$ are adjacent to each other in the Z direction.

The low-permeability layer 33 includes a separation portion $\mathbf{33}b_1$ and a separation portion $\mathbf{33}b_2$ between the coil conductor 24 and the coil conductor 25. The separation portion $\mathbf{33}b_1$ and the separation portion $\mathbf{33}b_2$ are adjacent to each other in the Z direction. The low-permeability layer 34 includes a separation portion $\mathbf{34}b_1$ and a separation portion $\mathbf{34}b_2$ between the coil conductor 25 and the coil conductor 26. The separation portion $\mathbf{34}b_1$ and the separation portion $\mathbf{34}b_2$ are adjacent to each other in the Z direction.

The element body regions S2 are interposed between the separation portions $\mathbf{31}b_1$, $\mathbf{31}b_2$, $\mathbf{32}b_1$, $\mathbf{32}b_2$, $\mathbf{33}b_1$, $\mathbf{33}b_2$, $\mathbf{34}b_1$, and $\mathbf{34}b_2$ adjacent to each other in the Z direction. That is, the element body regions S2 are formed between the separation portion $\mathbf{31}b_1$ and the separation portion $\mathbf{31}b_2$, between the separation portion $\mathbf{32}b_1$ and the separation portion $\mathbf{32}b_2$, between the separation portion $\mathbf{33}b_1$ and the separation portion $\mathbf{33}b_2$, and between the separation portion $\mathbf{34}b_1$ and the separation portion $\mathbf{34}b_2$.

In the boundary region R1, the coil conductors 21 to 23, the low-permeability layers 31 and 32, and the element body regions S1 and S2 are arranged on a virtual axis D along the Z direction, in order of the coil conductor 21, the element body region S1, the low-permeability layer 31, the element body region S2, the low-permeability layer 31, the element body region S1, the coil conductor 22, the element body region S1, the low-permeability layer 32, the element body region S2, the low-permeability layer 32, the element body region S1, and the coil conductor 23. That is, the boundary B1 between the coil conductors 21 to 23 and the low-permeability layers 31 and 32 and the element body 2 includes a surface crossing the Z direction. A boundary between one of the low-permeability layers 31 and 32 and the element body 2 also includes a surface crossing the Z direction.

In the boundary region R2, the coil conductors 24 to 26, the low-permeability layers 33 and 34, and the element body regions S1 and S2 are arranged on the virtual axis D along the Z direction, in order of the coil conductor 24, the element body region S1, the low-permeability layer 33, the element body region S2, the low-permeability layer 33, the element body region S1, the coil conductor 25, the element body region S1, the low-permeability layer 34, the element body region S2, the low-permeability layer 34, the element body region S1, and the coil conductor 26. That is, the boundary B2 between the coil conductors 23 to 26 and the low-permeability layers 33 and 34 and the magnetic material portion 11 includes a surface crossing the Z direction. A boundary between one of the low-permeability layers 33 and 34 and the element body 2 also includes a surface crossing the Z direction.

Even in the multilayer coil component according to the fourth embodiment, a direct-current superposition characteristic is improved and generation of a crack is suppressed, similar to the first to third embodiments.

In the multilayer coil component according to the fourth embodiment, the boundary between one of the low-permeability layers 31 to 34 and the element body 2 is not formed along the Z direction and crosses the Z direction. For this reason, the boundary between one of the low-permeability layers 31 to 34 and the element body 2 also functions as a resistance against a shearing stress along the Z direction and the shearing stress along the Z direction is dispersed in a direction crossing the Z direction. As a result, strength against the shearing stress along the Z direction is increased and the crack is hard to be generated.

The various embodiments have been described. However, the present invention is not limited to the embodiments and various changes, modifications, and applications can be made without departing from the gist of the present invention.

For example, the number of coil conductors, the number of magnetic gap layers, and the number of low-permeability layers in the element body 2 are not limited to the embodiments. For example, at least one low-permeability layer may be included in the element body 2 and a plurality of magnetic gap layers may be included in the element body 2.

In the fourth embodiment, the low-permeability layers 31 to 34 include the separation portions $\mathbf{31}b_1$ to $\mathbf{34}b_1$ and the separation portions $\mathbf{31}b_2$ to $\mathbf{34}b_2$, respectively. However, the present invention is not limited thereto. Each of the low-permeability layers 31 to 34 may include three or more separation portions.

In the embodiments, the thicknesses Tb of the low-permeability layers 31 to 34 are smaller than the thicknesses Ta of the coil conductors 21 to 26. However, the present invention is not limited thereto. For example, the thicknesses Tb of the low-permeability layers 31 to 34 may be equal to or larger than the thicknesses Ta of the coil conductors 21 to 26. In the embodiments, the thicknesses Ta of the plurality of coil conductors 21 to 26 are approximately the same, and the thicknesses Tb of the plurality of low-permeability layers 31 to 34 are approximately the same. However, the present invention is not limited thereto. The thicknesses Ta of the plurality of coil conductors 21 to 26 may be different from each other, and the thicknesses Tb of the plurality of low-permeability layers 31 to 34 may be different from each other.

In the embodiments, the low-permeability layers 31 to 34 are made of the non-magnetic material. However, the present invention is not limited thereto. For example, the low-permeability layers 31 to 34 may be made of a weakly magnetic material having permeability lower than the permeability of the element body 2.

In the embodiments, the low-permeability layers 31 to 34 have the frame shape. However, the present invention is not limited thereto. For example, parts of the low-permeability layers 31 to 34 may be cut. The low-permeability layers 31 to 34 may not be disposed in the second conductor portions of the coil conductors 21 to 26, when viewed from the Z direction. The low-permeability layers 31 to 34 may not overlap the separation regions of the coil conductors 21 to 26, when viewed from the Z direction.

What is claimed is:

1. A multilayer coil component comprising:

an element body that has magnetism;

a coil that includes a plurality of internal conductors electrically connected to each other and disposed one after another along a first direction in the element body, the plurality of internal conductors including conductor portions that are separated from each other in the first direction and overlap each other when viewed from the first direction; and at least one low-permeability layer that is disposed between two internal conductors adjacent to each other in the first direction, and that is disposed along the conductor portions of the two adjacent internal conductors in a second direction perpendicular to the first direction, the low-permeability layer having lower permeability than that of the element body, a first internal conductor of the two adjacent internal conductors having (1) a first surface and a second surface each extending in the second direction and opposing each other in the first direction and (2) a side surface connecting the first surface and the second surface, the first surface having an area larger than that of the second surface such that the side surface extends in a direction that is not parallel with the first direction, and the low-permeability layer having a third surface that extends in the second direction and is in contact with the second surface and not in contact with the first surface, the third surface having an area larger than that of the second surface, the third surface having a first portion corresponding to a portion of the third surface that overlaps the second surface when view in the first direction and a second portion corresponding to a portion of the third surface that does not overlap the second surface when view in the first direction, the second portion and the side surface forming a space between the second portion and the first surface in the first direction, wherein the element body includes a first element body region located in the space.

2. The multilayer coil component according to claim 1, wherein a thickness of the low-permeability layer in the first direction is smaller than thicknesses of the internal conductors in the first direction.

3. The multilayer coil component according to claim 1, wherein the low-permeability layer is located inside the internal conductors, when viewed from the first direction.

4. The multilayer coil component according to claim 1, wherein a diffusion layer in which a material included in the element body diffuse are formed on a side of the second portion of the low-permeability layer.

5. The multilayer coil component according to claim 1, wherein the at least one low-permeability layer includes a plurality of low-permeability layers each disposed between two adjacent internal conductors and each having a respective second portion, the second portions being arranged in the first direction, and the element body includes a second element body region that is interposed between two adjacent second portions in the first direction.

* * * * *